US006101949A

United States Patent [19]

Maucourt et al.

[11] Patent Number: 6,101,949

[45] Date of Patent: Aug. 15, 2000

[54] NON-TOXIC COMPOSITE PROJECTILES HAVING A BIODEGRADABLE POLYMERIC MATRIX FOR HUNTING OR SHOOTING CARTRIDGES

[75] Inventors: Jacques Maucourt, Vert le Petit; Claude Combette, Paris, both of France

[73] Assignee: Societe Nationale des Poudres et Explosifs, Paris Cedex, France

[21] Appl. No.: 09/071,780

[22] Filed: May 4, 1998

[30] Foreign Application Priority Data

May 23, 1997 [FR] France ..... 97 06323

[51] Int. Cl.[7] ..... F42B 10/00

[52] U.S. Cl. ..... 102/517; 102/439; 102/448; 102/501; 102/517

[58] Field of Search ..... 102/448, 439, 102/501, 517

[56] References Cited

U.S. PATENT DOCUMENTS

| | | |
|---|---|---|
| 2,995,090 | 8/1961 | Daubenspeck . |
| 4,949,645 | 8/1990 | Hayward et al. . |
| 5,549,048 | 8/1996 | Godfrey-Phillips . |
| 5,665,808 | 9/1997 | Bilsbury et al. . |
| 5,719,352 | 2/1998 | Griffin . |
| 5,786,416 | 7/1998 | Gardner et al. . |
| 5,814,759 | 9/1998 | Mravic et al. . |
| 5,936,190 | 8/1999 | Buzick . |

FOREIGN PATENT DOCUMENTS

| | | |
|---|---|---|
| 0181473 | 5/1986 | European Pat. Off. . |
| 0641836 | 3/1995 | European Pat. Off. . |
| 0731127 | 9/1996 | European Pat. Off. . |
| 1175274 | 12/1969 | United Kingdom . |

*Primary Examiner*—Michael J. Carone
*Assistant Examiner*—Daniel Beitey
*Attorney, Agent, or Firm*—Bucknam and Archer

[57] ABSTRACT

Composite spherical projectiles are provided for shotgun cartridges which are environmentally compatible, relatively inexpensive and have ballistic properties similar to lead shot or projectiles and which consist of metal particles dispersed in a biogradable polymeric solid matrix which includes a hydrocarbon binder containing ester functional groups which are linked to $C_{1-20}$ aliphatic hydrocarbon chains, starch, and titanium dioxide.

10 Claims, No Drawings

NON-TOXIC COMPOSITE PROJECTILES HAVING A BIODEGRADABLE POLYMERIC MATRIX FOR HUNTING OR SHOOTING CARTRIDGES

FIELD OF THE INVENTION

The present invention relates to the field of hunting and shooting with a shotgun, and more specifically to shooting using generally spherical projectiles, also called "lead shot", which are contained in hunting or shooting cartridges.

DESCRIPTION OF THE RELATED ART

Lead projectiles have been used for a very long time but, because of the toxicity of this metal, its use is becoming increasingly regulated and it has been proposed to replace the lead with other dense metals which are non-toxic, or are less toxic than lead such as, for example iron and tungsten. However these metal projectiles are too hard, thereby resulting, on the one hand, in rapid erosion of the shotgun's barrel and, on the other hand, in undesirable wounding and bleeding of the game which, if it is not killed by the shot, suffers unnecessarily, and sometimes even escapes despite its wounds.

In order in particular to remedy this hardness problem, it is now known to produce non-toxic composite projectiles consisting of fine non-toxic metal particles dispersed in a polymeric solid matrix.

Patents GB 2,149,067 and GB 2,200,976 describe, for example, spherical composite projectiles for cartridges obtained by extrusion or injection-moulding and consisting of particles rich in tungsten in a polyethylene or silicone-gum plastic.

Patent EP 641,836 describes compositions for cartridge projectiles consisting of dense particles, preferably of powdered tungsten, in a polymeric matrix comprising a thermoplastic rigid polymer, such as polypropylene or polystyrene, combined with a thermoplastic elastomer polymer such as polystyrene-based copolymers.

Patent PCT WO 94/24511 describes composite projectiles for cartridges consisting of finely divided metal particles, especially based on tungsten and/or molybdenum, which are dispersed in a polymeric matrix which can either be a thermoplastic, made of polystyrene, chlorosulphonated polyethylene or ethylene-vinyl acetate copolymer, or a thermosetting, made of epoxy resin or a formaldehyde-based resin.

However, these non-toxic composite projectiles representing the state of the art are very expensive because of the raw materials used or because of the methods used in processing and forming them and/or because of the fact that they exhibit ballistic properties which are distinctly inferior compared to those of conventional lead projectiles.

In addition, the polymeric matrix of these projectiles is not biodegradable, thereby resulting in undesirable pollution of the environment, especially of fields and meadows, or of the environment around shooting ranges.

The aforementioned Patent EP 641,836 clearly states the possible use of certain unsaturated polymers or copolymers in the polymeric matrix in order to promote, after shooting, its oxidative degradation by the oxygen in the air, but this document does not describe a composite projectile having a biodegradable matrix, that is to say a biodegradable one which degrades much more rapidly by biological mechanisms involving micro-organisms.

In general, upon oxidative degradation of the polymeric matrices used hitherto in composite projectiles for hunting or shooting cartridges, the binder decomposes very slowly, over several tens of years under the action of the oxygen in the air, into small completely imputrifiable macromolecular fragments which, although not visible, seriously damage the digestive system of animals which swallow them with the grass that they are grazing. In general, such fragments remain in existence well beyond one hundred years, as is the case for polyethylene.

Those skilled in the art are therefore seeking non-toxic composite projectiles for hunting or shooting cartridges having a polymeric matrix which is biodegradable in a very short space of time, which are not prohibitively expensive and have ballistic properties similar to those of conventional lead projectiles.

BRIEF SUMMARY OF THE INVENTION

The object of the present invention is specifically to provide such composite projectiles for hunting or shooting cartridges.

According to the invention, these composite projectiles, which are preferably spherical and consist of metal particles, preferably finely divided in the form of powder, dispersed in a solid polymeric matrix, are characterized in that the solid polymeric matrix is biodegradable and includes:

a hydrocarbon binder containing ester functional groups

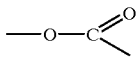

which are linked to hydrocarbon chains chosen from the group consisting of saturated or unsaturated aliphatic chains containing from 1 to 20 carbon atoms and preferably from 2 to 12 carbon atoms;

starch; and titanium dioxide.

"Solid" polymeric matrix should be understood to mean a solid matrix under the normal conditions in which the cartridges are used, i.e. at a pressure close to standard atmospheric pressure and at a temperature of between approximately −20° C. and approximately +50° C.

It has been unexpectedly observed that these non-toxic composite projectiles according to the invention had simultaneously quite a number of properties making them particularly attractive to use;

- all the organic constituents are completely biodegradable. After exposure to light and rain, in times which may be as short as 1 to 2 years, they leave no particle capable of harming an animal;
- the ballistic behaviour is close to that of lead projectiles;
- the manufacturing cost is no longer prohibitive and is very markedly less than that of known composite projectiles, especially because of the nature of the polymeric matrix and of the simplicity of the method employed for processing and forming them, which can very easily be extrapolatable to industrial-scale production;
- the density of the projectiles is greater than or equal to that of steel;
- the projectiles are particularly non-erosive. They do not damage the barrel of shotguns and do not require special arrangements of the weapons or munitions;
- the ability to ricochet off any obstacle is slight and penetration into the bark of trees is as low as with lead projectiles; and
- the particularly high capability of the binder according to the invention to provide cohesion of the metal particles, thereby allowing high filler contents, which may be greater than approximately 95% by weight.

DETAILED DESCRIPTION OF THE INVENTION

According to a first preferred embodiment of the invention, titanium oxide is in the anatase form.

The rutile form can also be used, but it has been found, unexpectedly, that the use of the anatase form made it possible for the polymeric matrix to undergo biodegradation more rapidly.

According to a second preferred embodiment of the invention, the hydrocarbon binder also contains, in addition to the ester functional groups, urethane functional groups and/or amide functional groups

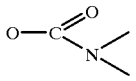

and/or amide functional groups

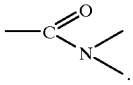

Surprisingly, it has been found that, in particular, the urethane functional groups, combined with the ester functional groups, made it possible for the polymeric matrix to undergo biodegradation more rapidly.

Advantageously, the molar ratio between the urethane groups and the ester groups is less than 0.05.

According to a third preferred embodiment of the invention, the polymeric matrix also comprises at least one additive chosen from the group consisting of alkali metal stearates, alkaline earth metal stearates alkali metal carbonates, alkaline earth metal carbonates, alkali metal sulphates and alkaline earth metal sulphates.

Inexplicably, it has been found that the presence of such an additive also promoted the biodegradation of the polymeric matrix.

Advantageously, this additive consists of a mixture of calcium stearate and calcium carbonate.

According to another preferred embodiment of the invention, the polymeric matrix also includes a plasticizer. In addition to the plasticizing function of the hydrocarbon binder, allowing or favouring implementation using standard techniques for forming thermoplastics, such as injection-moulding or extrusion, it has been found that the presence of this plasticizer also promoted the biodegradation of the polymeric matrix.

The plasticizers particularly preferred are trialkylacetyl citrates, especially those in which the alkyl radicals each contain from 2 to 4 carbon atoms, such as, for example, triethylacetyl citrate and tributylacetyl citrate.

The preferred polymeric matrices according to the invention contain:

- at least 75% by weight of binder, preferably between 75% by weight and 90% by weight;
- at least 2.5% by weight of starch, preferably between 2.5% by weight and 20% by weight;
- at least 0.5% by weight of titanium oxide in anatase form, preferably between 0.5% by weight and 5% by weight;
- at least 0.5% by weight of calcium carbonate, preferably between 0.5% by weight and 2.5% by weight;
- at least 0.5% by weight of calcium stearate, preferably between 0.5% by weight and 1% by weight;
- at least 1% by weight of a trialkylacetyl citrate, preferably between 1% by weight and 10% by weight.

According to another preferred embodiment, the composite projectiles according to the invention have a density of between 7.5 g/cm$^3$ and 10.5 g/cm$^3$.

According to another preferred embodiment, the metal particles consist of tungsten or of an alloy containing tungsten, although it is possible, within the context of the invention, to use many other metals such as tin, molybdenum, titanium, bismuth, iron and copper.

Alloys containing tungsten are particularly preferred, especially those with iron, more particularly those for which the tungsten content by weight is between 30% and 70%, preferably between 40% by weight and 60% by weight.

These tungsten-iron alloys may also include other metals, such as nickel and cobalt.

According to another preferred embodiment, the metal particles are in the form of powder, the medium diameter of which is preferably between 10 $\mu$m and 300 $\mu$m.

In general, within the context of the present invention, the composite projectiles contain:

- between 90% and 97% by weight of metal particles, preferably between 94% and 97% by weight and even more preferably between 95% and 97% by weight; and
- between 3% and 10% by weight of polymeric matrix, preferably between 3% and 7% by weight and even more preferably between 3% and 5% by weight.

The composite projectiles according to the invention may also contain, in low content, various additives well known to those skilled in the art for this type of projectile, for example a demoulding lubricating agent such as calcium stearate.

With regard to obtaining the aforementioned composite projectiles according to the invention, the composition corresponding to the polymeric matrix is first of all prepared, preferably in the form of thermoplastic granules, from thermoplastic hydrocarbon binders containing ester functional groups linked to $C_1$–$C_{20}$ aliphatic hydrocarbon chains, some of which are commercial products, and which can, for example, be obtained by the reaction of an aliphatic diol, such as 1,4-butanediol, with an aliphatic diacid, such as succinic acid or adipic acid.

In order to extend the chains of the polyester thermoplastic binder, the formulation of this binder may contain a small amount of an aliphatic or cycloaliphatic diisocyanate, in order to introduce a few urethane functional groups, or else may contain an aliphatic diamine or a lactam, in order to introduce amide functional groups, for example of the polycaprolactam type.

Preferably, the binder in granule form and the other constituents of the polymeric matrix are introduced into a heated mixer, for example of the Buss "Ko-kneader" type well known to those skilled in the art, so as to form a homogeneous paste.

By means of a die and then a granulator, the composition may be recovered in the form of thermoplastic granules, for example cylindrical granules, the length of which, about one mm or a few mm, is similar to the diameter.

Next, a moulding powder based on these thermoplastic granules and on metal particles may be produced, either using a "dry" route by agitation in a mixer after grinding the granules, or using a "solvent" route by dissolving the thermoplastic granules in a solvent such as chloroform in the presence of metal particles and then evaporating the solvent while stirring the mixture.

Next, the composite projectiles according to the invention may be obtained by pelletizing this moulding powder, for example at room temperature (approximately 20° C.), in moulds containing impressions having the desired shape.

According to another embodiment, by replacing the moulding powder it is possible to produce cylindrical granules, for example having a diameter of 3 mm and a length of 3 mm, by cokneading followed by extrusion and cutting. These cylindrical granules are then injected into moulds having the desired shape using an injection-moulding machine for thermoplastics.

The following non-limiting examples illustrate the invention and the advantages that it provides.

EXAMPLE 1

Production of non-toxic spherical (3 mm diameter) composite projectiles according to the invention, having a polyesterurethane biodegradable polymeric matrix and a density of 7.9 g/cm$^3$.

a) Preparation of thermoplastic granules (composition for the polymeric matrix of the projectiles)

The polyesterurethane binder, sold in the form of granules by the company Showa Denko under the brand name BIONOLLE® 3001, which is a copolymer of 1,4-butanediol, adipic acid, succinic acid and a cycloaliphatic diisocyanate, as well as the following constituents in an amount such that the following composition is obtained:

BIONOLLE® 3001 binder: 87.5% by weight
corn starch: 8.0% by weight
tributylacetyl citrate: 3.0% by weight
$TiO_2$ in anatase form: 0.5% by weight
calcium carbonate: 0.5% by weight
calcium stearate: 0.5% by weight are introduced into a Buss "Ko-kneader" heated to approximately 175° C.

After forming a homogeneous paste and using a transfer screw, the paste is taken through a die having a diameter of approximately 2 mm.

After leaving the die, the strands are taken under water into a granulator.

Finally, cylindrical thermoplastic granules having a diameter of approximately 2 mm, a length of approximately 2 mm and a density of 1.24 g/cm$^3$ are obtained.

b) Preparation of a moulding powder via a "dry" route

After cryogenically grinding the thermoplastic granules obtained from a), so as to obtain a powder having a median diameter of 150 $\mu$m, the following are homogenized, at room temperature, by agitation in a mixer:

- 4.5 parts by weight of the aforementioned powder of 150 $\mu$m median diameter;
- 95 parts by weight of a powder of 90 $\mu$m median diameter made of an iron-tungsten alloy of density 10.7 g/cm$^3$, the Fe/W proportions by weight of which are respectively 45/55; and
- 0.5 parts by weight of calcium stearate (demoulding agent).

A moulding powder is thus obtained.

b) Production and evaluation of the composite projectiles

The moulding powder obtained at b) is compacted, with the aid of a pelletizer, at room temperature and at a pressure of several hundred bar, into a multi-impression mould, each impression consisting of two hemispherical cavities of 3 mm internal diameter.

After demoulding, the spherical composite projectiles obtained have a density of 7.9 g/cm$^3$.

A satisfactory ballistic behaviour has been observed when firing a hunting cartridge containing 32 g of these projectiles, equally well at −20° C. as at +20° C. and +50° C., with a malleability and integrity which are comparable to those of a lead projectile.

These projectiles, left in contact with a dirt floor in a natural environment at ambient temperature disintegrate very rapidly under the effect of light and micro-organisms, especially bacteria.

After a few weeks, cracks appear, followed by disintegration of the projectile.

After 6 months, and then a year, there remains, respectively, only approximately 60% by weight and only approximately 30% by weight of the polymeric matrix.

After a period of approximately 2 years, this matrix completely disappears.

A biodegradation test, according the ASTM D 5988-96 Standard, was also carried out using a projectile reduced to a powder and then mixed with earth. After 95 days, biodegradation of the matrix is complete.

Moreover, a comparative test, carried out strictly under the same conditions according to the ASTM D 5988-96 Standard, using cellulose shows complete disappearance of the cellulose in approximately the same time.

It has thus been observed, surprisingly, that the polymeric matrix of the projectiles according to the invention biodegrade as rapidly as cellulose.

EXAMPLE 2

Production of non-toxic spherical (3 mm diameter) composite projectiles according to the invention, having a polyesteramide biodegradable polymeric matrix of density 7.8 g/cm$^3$.

a) Preparation of thermoplastic granules (composition for the polymeric matrix of the projectiles)

The procedure is repeated strictly as in Example 1, but by using, instead of the BIONOLLE® polyesterurethane binder, the polyesteramide binder sold in the form of granules by the company Bayer under the brand name BAK® 1095, which is a copolymer of 1,4-butanediol, adipic acid and caprolactam.

Thermoplastic cylindrical granules having a diameter of 2 mm, a length of 2 mm and a density of 1.17 g/cm$^3$ are obtained.

b) Preparation of a moulding powder via a "solvent" route

The following are introduced into a Z-blade mixer:

4.5 parts by weight of thermoplastic granules obtained at a);
95 parts by weight of a powder, having a median diameter of 90 $\mu$m, of an iron-tungsten alloy of density 10.7 g/cm$^3$, the proportions by weight of which are respectively 45/55;
0.5 parts by weight of calcium stearate (demoulding agent); and
50 parts by weight of chloroform (solvent).

After dissolving the granules and homogenizing the mixture by slowly stirring at room temperature for approximately ½ h, the solvent is slowly evaporated, by gentle heating, while continuing to stir.

A moulding powder consisting of metal powder particles coated with a polymeric film are thus obtained.

c) Production and evaluation of the composite projectiles

The procedure is repeated strictly as in Example 1 using the moulding powder obtained at b).

Spherical composite projectiles having a diameter of 3 mm and a density of 7.8 g/cm$^3$ are obtained.

Satisfactory ballistic behaviour has been observed when firing a hunting cartridge containing 32 g of these projectiles, equally well at −20° C. as at +20° C. and +50° C., with a malleability comparable to that of a lead projectile.

These projectiles, left in contact with a dirt floor in a natural environment, rapidly crack, after a few weeks; the projectile then disintegrates after a few months.

The polymeric matrix completely disappears after a few years.

What is claimed is:

1. Non-toxic composite projectile for hunting or shooting shotgun cartridges, consisting of metal particles dispersed in a polymeric solid matrix, characterized in that the polymeric solid matrix is biodegradable and includes:

a hydrocarbon binder containing ester functional groups which are linked to hydrocarbon chains chosen from the group consisting of saturated or unsaturated aliphatic chains containing from 1 to 20 carbon atoms;

starch; and titanium dioxide.

2. Projectile according to claim 1, characterized in that its density is between 7.5 g/cm$^3$ and 10.5 g/cm$^3$.

3. Projectile according to claim 2, characterized in that the metal particles consist of tungsten or of an alloy containing tungsten.

4. Projectile according to claim 3, characterized in that the alloy containing tungsten is a tungsten-iron alloy.

5. Projectile according to claim 1, characterized in that the titanium dioxide is in anatase form.

6. Projectile according to claim 1, characterized in that the aliphatic hydrocarbon chains contain from 2 to 12 carbon atoms.

7. Projectile according to claim 1, characterized in that the binder also contains urethane and/or amide functional groups.

8. Projectile according to claim 1, characterized in that the polymeric matrix also contains at least one additive chosen from the group consisting of alkali metal stearates, alkaline-earth metal stearates, alkali metal carbonates, alkaline-earth metal carbonates, alkali metal sulphates and alkaline-earth metal sulphates.

9. Projectile according to claim 1, characterized in that the polymeric matrix also contains a plasticizer.

10. Projectile according to claim 1, characterized in that the polymeric matrix contains:

at least 75% by weight of binder;

at least 2.5% by weight of starch;

at least 0.5% by weight of titanium oxide in anatase form;

at least 0.5% by weight of calcium carbonate;

at least 0.5% by weight of calcium stearate; and at least 1% by weight of a trialkylacetyl citrate.

* * * * *